US005284215A

United States Patent [19]

Tibbitts

[11] Patent Number: 5,284,215

[45] Date of Patent: Feb. 8, 1994

[54] EARTH-BORING DRILL BIT WITH ENLARGED JUNK SLOTS

[75] Inventor: Gordon A. Tibbitts, Salt Lake City, Utah

[73] Assignee: Baker Hughes Incorporated, Houston, Tex.

[21] Appl. No.: 805,847

[22] Filed: Dec. 10, 1991

[51] Int. Cl.[5] ..... E21B 10/60

[52] U.S. Cl. ..... 175/340; 175/393

[58] Field of Search ..... 175/339, 340, 393, 417

[56] References Cited

U.S. PATENT DOCUMENTS

| | | | |
|---|---|---|---|
| 3,112,803 | 12/1963 | Rowley | 175/329 |
| 3,757,878 | 9/1973 | Wilder et al. | 175/329 |
| 3,757,879 | 9/1973 | Wilder et al. | 175/329 |
| 4,116,289 | 9/1978 | Feenstra | 175/329 |
| 4,515,227 | 5/1985 | Cerkovnik | 175/65 |
| 4,550,790 | 11/1985 | Link | 175/329 |
| 4,554,986 | 11/1985 | Jones | 175/397 |
| 4,696,354 | 9/1987 | King et al. | 175/329 |
| 4,869,330 | 9/1989 | Tibbitts | 175/393 |
| 4,877,096 | 10/1989 | Tibbitts | 175/410 |
| 4,883,132 | 11/1989 | Tibbitts | 175/65 |
| 4,884,477 | 12/1989 | Smith et al. | 76/108 |
| 4,913,244 | 4/1990 | Trujillo | 175/65 |

FOREIGN PATENT DOCUMENTS 0312487 4/1989 European Pat. Off. .

*Primary Examiner*—William P. Neuder

*Attorney, Agent, or Firm*—Marger, Johnson, McCollom & Stolowitz

[57] ABSTRACT

A drill bit includes a generally cylindrical central blank and a matrix portion mounted on the lower end of the blank which includes the crown and gage of the drill bit. Exceptionally deep junk slots are defined in the matrix portion. The lower end of the blank includes a radially inwardly tapering portion having matrix material formed thereover which defines an upper end of the junk slot. The matrix material is formed from powdered matrix material and a ductile filler which provides a matrix with a relatively high ductility. Also disclosed is a steel bit constructed in accordance with the present invention.

25 Claims, 2 Drawing Sheets

EARTH-BORING DRILL BIT WITH ENLARGED JUNK SLOTS

BACKGROUND OF THE INVENTION

1. Field of the Invention

The present invention relates to earth-boring drill bits of the type which include exceptionally deep junk slots.

2. Description of the Related Art

Typically, earth boring drill bits include a bit body which may be of steel or may be fabricated of a hard matrix material such as tungsten carbide. A plurality of diamond or other cutting elements are mounted along the exterior face of the bit body. Each diamond cutting element typically has a backing portion which is mounted in a recess in the exterior face of the bit body. Depending upon the design of the bit body and the type of diamonds used (i.e., either natural or synthetic), the cutters are either positioned in a mold prior to formation of the bit body or are secured to the bit body after fabrication.

The cutting elements are positioned along the leading edges of the bit body so that as the bit body is rotated in its intended direction of use, the cutting elements engage and drill the earth formation. In use, tremendous forces are exerted on the cutting elements, particularly in the forward to rear tangential direction as the bit rotates, and in the axial direction of the bit. Additionally, the bit body and cutting elements are subjected to substantial abrasive and erosive forces.

Tungsten carbide or other hard metal matrix bits have the advantage of high erosion and abrasion resistance. The matrix bit is generally formed by packing a graphite mold with tungsten carbide powder and then infiltrating the powder with a molten copper alloy binder. A steel blank is positioned in the mold and becomes secured to the matrix as the bit cools after furnacing. Also present in the mold is a mandrel which, when removed after furnacing, leaves behind the fluid passages through the bit. After molding and furnacing of the bit, the end of the steel blank can be welded or otherwise secured to an upper threaded body portion of the bit.

Such tungsten carbide or other hard metal matrix bits, however, are brittle and can crack upon being subjected to impact forces encountered during drilling. Additionally, thermal stresses from the heat applied during fabrication of the bit or during drilling may cause cracks to form. Finally, tungsten carbide and other erosion resistant materials are very expensive in comparison with steel as a material of fabrication.

U.S. Pat. No. 4,884,477 to Smith et al discloses a method for making a drill bit in which relatively ductile filler material is placed in the bit mold prior to infiltrating the same in a furnace. A hard metal matrix material is provided on the exterior surface of the crown and gauge of the bit while increasing the overall ductility of the matrix thus providing a less brittle and yet still wear resistance bit.

For many years, diamond bits which incorporated a bit blank in an infiltrated matrix were shaped much like the bit disclosed in the Smith patent. The matrix comprises a relatively thin layer of hard matrix comprising the gage and crown of the bit. Junk slots, which comprise grooves formed in the matrix via junk slot displacements in the mold, extend from the crown vertically up the sides of the gauge. The junk slots provide a flow path for drilling fluid which circulates out of the lowermost portion of the bit into the borehole to cool the bit with less cuttings from the bore.

In some soft formation bits constructed as described above, drilling fluid cannot flow at sufficiently high rates to circulate the cuttings from the well bore due to the relatively small cross sectional flow area between the bit crown and the borehole, which restricts fluid flow. Although such bits include junk slots as described above, they are not sufficiently deep or wide enough to accommodate a sufficiently high flow rate.

SUMMARY OF THE INVENTION

A drill bit comprises a shank having a general cylinder surface. The shank includes means for connecting the upper end thereof to a drill string of drill pipe. The shank is connected to a bit body which includes a junk slot formed therein for transporting fluid and cuttings from the cutting face of the bit. The junk slot has a bottom surface which is substantially interior of a cylinder containing the radially outer surface of the shank. In another aspect, an elongate blank is mounted on the lower end of the shank. The blank and shank longitudinal axes are coaxial. An integral matrix is formed about the circumference of the blank and about the circumference of the lower portion of the shank.

A junk slot is formed in the matrix and extends from the lower portion thereof into that portion of the matrix formed about the circumference of the shank. A method for making the drill bit is also provided.

The present invention comprises a tough diamond bit which has exceptionally deep junk slots. The bit of the invention is thus especially well suited for drilling in soft formations where very high rates of penetration can be achieved.

DETAILED DESCRIPTION OF THE PREFERRED EMBODIMENT

Figure 1:
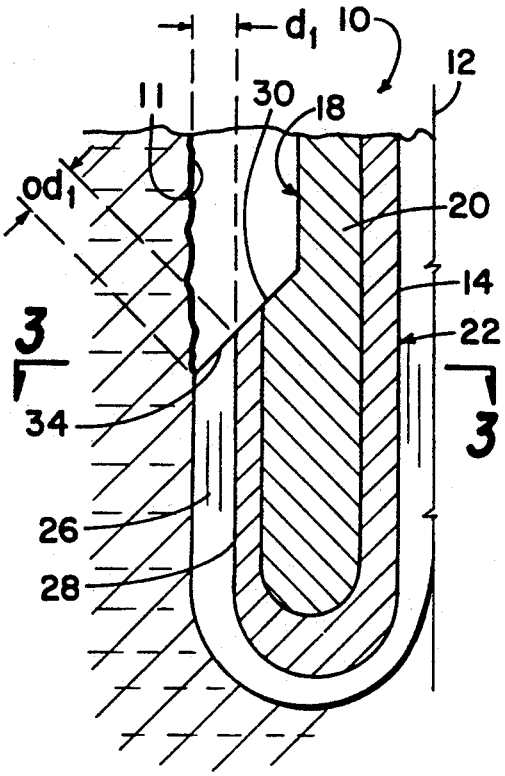
Fig. 1 (PRIOR ART)
FIG. 1 is a partial sectional view taken through a junk slot on a prior art matrix drill bit received in a borehole.

Prior to considering the drill bit of the present invention, consideration will first be given to a prior art bit indicated generally at 10 in FIGS. 1-3. Bit 10 is received in a borehole 11 and includes a central longitudinal axis 12 and a coaxial bore 14. Bore 14 is also coaxial with a cylindrical blank 18 which includes an upper portion or shank 20. The shank includes threads (not shown) at the upper portion thereof for connecting the drill bit to a string of drill pipe (also not shown). Blank 18 is comprised of a relatively ductile steel which has a coating of matrix material 22 bonded thereto. Bore 14 is formed through the matrix material. A junk slot 24 is also formed in matrix material 22 and includes a pair of opposed sides, one of which is side 26. A bottom surface 28 connects lower edge of each of the sides, like side 26.

Figure 2:
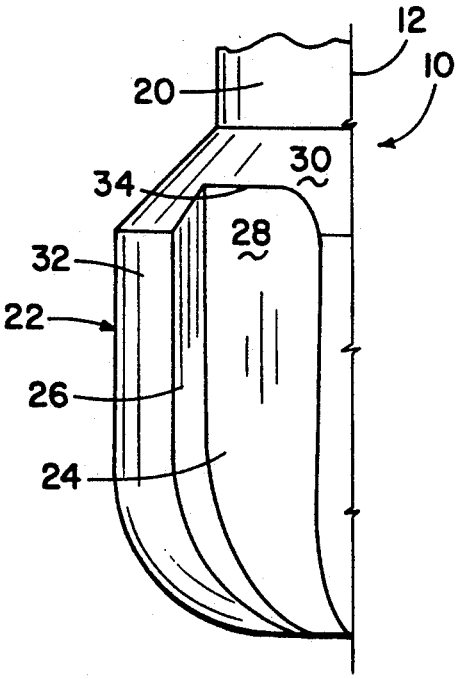
Fig. 2 (PRIOR ART)
FIG. 2 is a partial front elevation view of the prior art drill bit of FIG. 1 rotated slightly to show the junk slot.
Figure 3:
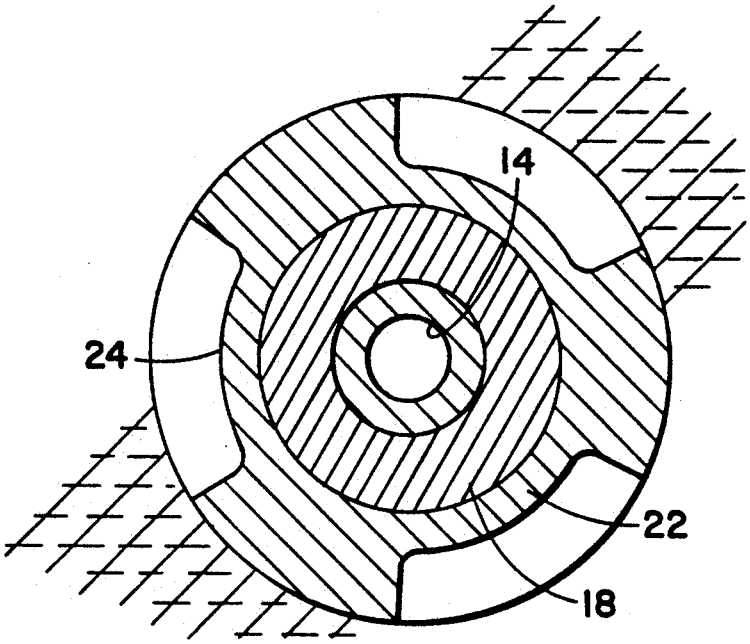
Fig. 3 (PRIOR ART)
FIG. 3 is a cross sectional view taken along line 3—3 in FIG. 1.

In the view of FIG. 2, drill bit 10 is rotated about axis 12 relative to the view of FIG. 1 to better show junk slot 24 in FIG. 2.

A circumferential chamfered surface 30 extends from a radially outer surface or gage 32 formed on the matrix material to the radially outer surface 30.

So that the structure of the junk slot may be clearly viewed, cutters which are normally mounted on gage 32 and on the crown of the bit are not shown. It should, however, be appreciated that this type of prior art drill bit can utilize cutters integrally secured to the matrix during the furnace infiltration process or cutters which are mounted on the hardened matrix, after infiltration, to form the bit body. Drill bit 10 may be formed using the infiltration method disclosed in U.S. Pat. No. 3,757,879 to Wilder et al for drill bits and methods of producing drill bits which is incorporated herein by reference.

Drill bit 10 must utilize a relatively ductile blank 18 to impart sufficient ductility to the bit to prevent fracture due to the brittle nature of matrix material 22. The depth of junk slot 24, indicated by the designation $d_1$ in FIG. 1, cannot be much if any, more than illustrated in FIG. 1 because there must be a sufficient volume of blank 18 material in the body of the bit enable the bit to absorb shock without fracture. Also, matrix material 22 must coat the blank on the crown and gage of the bit to provide sufficient hardness to resist the forces applied to the cutter and to prevent erosion due to hydraulic action of the drilling fluid. Similarly, the opening depth, denominated $od_1$ in FIG. 1, of the junk slot is limited for the same reasons. As illustrated in FIG. 2, the maximum width of the junk slot is limited so that a sufficient number of cutters can be disposed on the crown and gage of the bit. Thus, when a bit like bit 10 is used to drill in a soft formation in which high rates of penetration are achieved, the junk slots restrict flow of the drilling fluid and formation chips thereby causing clogging of the bit and/or necessitating drilling at a lower rate of penetration than might otherwise be achieved.

Figure 4:
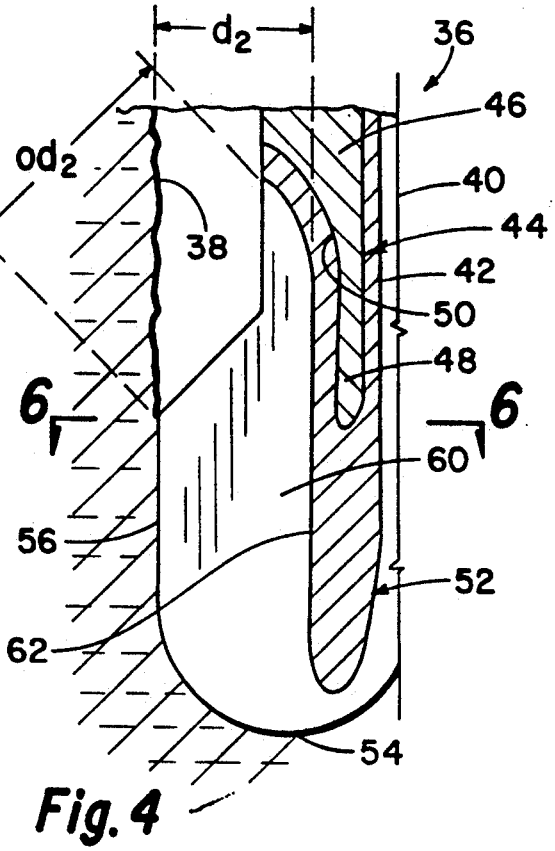
FIG. 4 is a partial cross sectional view taken through a junk slot on a drill bit constructed in accordance with the present invention received in a borehole.
Figure 5:
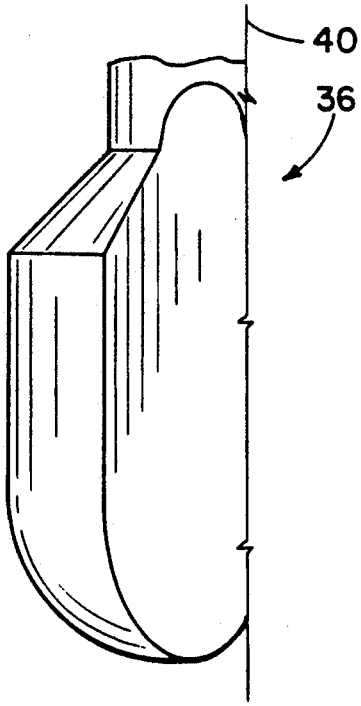
FIG. 5 is a partial front elevation view of the drill bit of FIG. 4 rotated slightly to show the junk slot.
Figure 6:
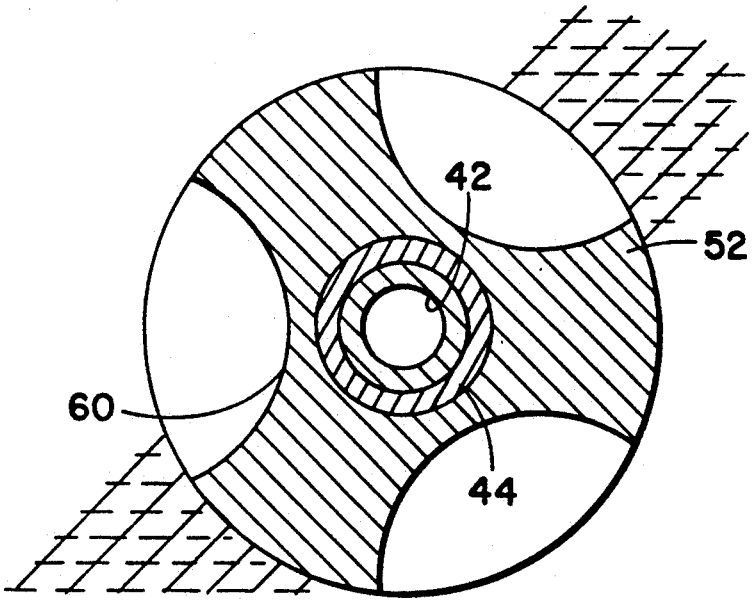
FIG. 6 is a cross sectional view taken along line 6—6 in FIG. 4.

Turning now to FIGS. 4–6, indicated generally at 36 is a drill bit constructed in accordance with the present invention. Drill bit 36 is shown received in a borehole 38. A center axis 40 defines the longitudinal axis of both borehole 38 and bit 36. A bore 42 is likewise centered about axis 40 and communicates with an upper end of the drill bit (not shown) to provide fluid to the drilling surface of the bit which is circulated up the annulus between borehole 38 and a pipe string (not shown) to which the bit is connected. A generally cylindrical blank 44 includes an upper portion or shank 46 and a lower portion 48. The upper and lower portions may be formed separately and joined as by welding or may be integral as illustrated in FIG. 4. Shank 46 includes a set of threads (not shown) at the upper end thereof for connecting the bit to a string of drill pipe. As used herein, the radially outer surface of the shank refers to the diameter of the shank at the surface containing the threads. In the present embodiment of the invention, the diameter of the shank 46 visible in the drawing is equal to the diameter of the shank at the threaded portion thereof.

Lower portion 48 of the blank includes a radially inwardly tapering surface 50 which is interior of a cylinder containing the radially outer surface of shank 46. Matrix material 52 is bonded to lower portion 48 and includes a lower surface or a crown 54 and a radially outer surface or gage 56. Gage 56 is also referred to herein as a radially outer surface of matrix 52.

The matrix includes a circumferential chamfered surface 58 which extends between shank 46 and gage 56 about the circumference of the bit. A junk slot 60 has a depth $d_2$ as measured between gage 56 and a bottom surface 62 (in FIG. 4) of the junk slot. The junk slot has an opening at the upper end thereof which communicates with the annulus between the bit and borehole 38 and which has an opening depth $od_2$. Bottom surface 62 of the junk slot is interior of a cylinder containing shank 46.

In manufacturing the bit of the present invention, steel is machined or otherwise formed via conventional processes in the shape of blank 44. A graphite mold (not shown) is constructed, using conventional mold construction techniques, having an interior shape which defines the radially outer surfaces of matrix material 52, including gage 56, surface 58 and junk slot 60.

A cylindrical mandrel (not shown) is centered on axis 40 and inserted into the longitudinal bore in blank 44 in which bore 42 is formed. If the bit is to be of the type having thermally stable diamond cutters formed integrally therewith, the cutters are appropriately positioned inside the mold. Thereafter the spaces between the mandrel and blank 44 and between the blank and the mold are packed with a mixture of powdered matrix material and a ductile filler material in accordance with the process of U.S. Pat. No. 4,884,477 to Smith et al. which is incorporated herein by reference. The mold is then placed in a furnace and the powdered matrix material is infiltrated thereby forming a bit matrix having a relatively high ductility thus forming the bit illustrated in FIGS. 4–6.

In operation, drill bit 36 is lowered into borehole 38 suspended in the usual manner on the lower end of a string of drill pipe. Drilling fluid is circulated through the pipe into bore 42 and into the space between the crown and the borehole, including the junk slots. During drilling, such circulating fluid cools the bit and flushes cuttings from between the bit and borehole to the surface via the annulus between the drill string and the borehole. Bit 36 is especially advantageous in relatively soft formations in which high rates of penetration are achieved. The deep junk slots permit a higher ratio of fluid volume to the volume of cuttings in the fluid therefore reducing the tendency of the junk slots to become packed with cuttings regardless of the rate of circulation of drilling fluid.

In another embodiment, the bit can be integrally formed from a single material, e.g., steel, having an exterior shape like that shown in FIGS. 4–6 thus providing the above-described advantages associated with exceptionally deep junk slots.

It should be appreciated that the invention can be implemented in a drill bit having a reduced shank diameter between the shank threads and the bit body. Such a bit could have a reduced-diameter shank portion having a radially outer surface which is radially inward from the bottom surface of the junk slot and still be within the scope of the following claims.

Having illustrated and described the principles of my invention in a preferred embodiment thereof, it should be readily apparent to those skilled in the art that the invention can be modified in arrangement and detail without departing from such principles.

I claim all modifications coming within the spirit and scope of the accompanying claims.

1. A drill bit comprising:
a shank having a generally cylindrical surface and including means for connecting the upper end thereof to a drill string pipe;
a blank mounted on the lower end of said shank and having a longitudinal axis coaxial with said shank axis;
an integral matrix formed about the circumference of said blank;
a circumferential chamfered surface concentric with said blank, said surface being formed entirely on said matrix; and
a junk slot formed in said matrix and extending from a lower portion thereof to said chamfered surface.

2. The drill bit of claim 1 wherein said junk slot extends through said chamfered surface.

3. The drill bit of claim 1 wherein said matrix has a longitudinal axis coaxial with said shank axis and blank axis and said matrix further includes a radially outer surface in which said junk slot is formed, said junk slot extending from said radially outer surface to a depth substantially toward said matrix axis.

4. The drill bit of claim 1 wherein said blank includes a radially inwardly tapering portion on the lower end thereof.

5. The drill bit of claim 4 wherein that portion of the matrix formed about the circumference of said blank is formed about said inwardly tapering portion and said matrix further includes a radially outer surface cocylindrical with the radially outer surface of said shank.

6. A drill bit comprising:
a generally cylindrical blank having an upper portion and a lower portion;
a radially outer surface formed on the lower portion of said blank within a cylinder containing the radially outer surface of the upper portion of said blank;
a bit matrix formed about the lower portion of said blank; and
a junk slot formed in said matrix for transporting fluid and cuttings from the cutting face of said bit, said junk slot having a bottom surface which is substantially within the cylinder containing the radially outer surface of the upper portion of said blank.

7. The drill bit of claim 6 wherein said bit matrix and said cylindrical blank are centered on a common axis and said matrix includes a radially outer surface in which said junk slot is formed, said slot extending from said radially outer surface to a depth substantially toward said axis.

8. The drill bit of claim 6 wherein said blank upper portion comprises a shank and wherein said shank includes means for connecting the upper end thereof to a drill pipe string, said drill bit further including a circumferential chamfered surface defined in said matrix.

9. The drill bit of claim 8 wherein said junk slot extends through said chamfered surface.

10. The drill bit of claim 9 wherein said blank lower portion comprises a radially inwardly tapering portion.

11. The drill bit of claim 10 wherein that portion of the matrix formed about the blank lower portion is formed about said inwardly tapering portion, said matrix further including a radially outer surface cocylindrical with the radially outer surface of said shank.

12. The drill bit of claim 6 wherein said matrix has a longitudinal axis coaxial with said blank axis and said matrix further includes a radially outer surface in which said junk slot is formed, said slot extending from said radially outer surface to a depth of over half way to said matrix axis.

13. A drill comprising:
a bit body;
a generally cylindrical shank extending from an upper portion of said bit body;
a junk slot formed in said bit body for transporting fluid and cuttings from the cutting face of said bit, said junk slot having a bottom surface which is substantially within a cylinder containing the radially outer surface of said shank.

14. The drill bit of claim 13 wherein said bit body and said shank are centered on a common axis and said bit body includes a radially outer surface in which said junk slot is formed, said slot extending from said radially outer surface to a depth substantially toward said axis.

15. The drill bit of claim 13 wherein said shank includes means for connecting the upper end thereof to a drill pipe string, said drill bit further including a circumferential chamfered surface defined in said bit body.

16. The drill bit of claim 15 wherein said junk slot extends through said chamfered surface.

17. The drill bit of claim 13 wherein said bit body and said shank are coaxial and wherein said slot extends from a radially outer surface of said bit body to a depth of over half way to said bit body axis.

18. A drill bit comprising:
a shank having a generally cylindrical surface and including means for connecting the upper end thereof to a drill string pipe;
a blank mounted on the lower end of said shank and having a longitudinal axis coaxial with said shank axis;
an integral matrix formed about the circumference of said blank;
a circumferential chamfered surface formed on said matrix and concentric with said blank; and
a junk slot formed in said matrix and extending from a lower portion thereof through said chamfered surface.

19. The drill bit of claim 18 wherein said junk slot extends above said chamfered surface.

20. The drill bit of claim 1 wherein said junk slot extends above said chamfered surface.

21. The drill bit of claim 5 wherein said junk slot extends into the radially outer surface of said matrix cocylindrical with the radially outer surface of said shank.

22. The drill bit of claim 1 wherein said matrix includes a gauge surface directed in a generally lateral direction and wherein said chamfered surface extends upwardly from said gauge surface.

23. A drill bit comprising:
a shank having a generally cylindrical surface and including means for connecting the upper end thereof to a drill string pipe;
a blank mounted on the lower end of said shank and having a longitudinal axis coaxial with said shank axis and further having a radially inwardly tapering portion on the lower end thereof;
an integral matrix formed about the circumference of the inwardly tapering portion of said blank, said matrix further having an upper radially outer surface substantially cocylindrical with the radially outer surface of said shank.

24. The drill bit of claim 23 wherein said matrix includes a gauge surface and a chamfered surface extending upwardly from said gauge surface.

25. The drill bit of claim 24 wherein said chamfered surface is formed entirely on said matrix.

* * * * *